US007221079B2

(12) United States Patent
Hanashi

(10) Patent No.: US 7,221,079 B2
(45) Date of Patent: May 22, 2007

(54) SPARK PLUG WITH A PLURALITY OF GROUND ELECTRODES

(75) Inventor: Ken Hanashi, Chiryu (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 113 days.

(21) Appl. No.: 11/139,995

(22) Filed: May 31, 2005

(65) Prior Publication Data

US 2005/0264153 A1 Dec. 1, 2005

(30) Foreign Application Priority Data

May 31, 2004 (JP) ..... 2004-161827

(51) Int. Cl.
*H01T 13/20* (2006.01)

(52) U.S. Cl. ..... 313/143; 313/141

(58) Field of Classification Search ..... 313/118, 313/141, 140, 142, 143
See application file for complete search history.

(56) References Cited

U.S. PATENT DOCUMENTS 5,929,556 A 7/1999 Matsubara et al.
6,229,253 B1 5/2001 Iwata et al.
6,552,476 B1 4/2003 Hanashi et al.

FOREIGN PATENT DOCUMENTS

JP 9-199260 7/1997
JP 2000-68032 3/2000
JP 2001-93645 4/2001

*Primary Examiner*—Joseph Williams
(74) *Attorney, Agent, or Firm*—Nixon & Vanderhye P.C.

(57) ABSTRACT

A spark plug according to the invention includes a metal shell, an insulator, a center electrode, a first ground electrode, and a second ground electrode. The metal shell has a threaded portion with an outer diameter in a range of 12 to 14 mm. The first ground electrode is aligned with the center electrode in an axial direction of the spark plug to form a first spark gap across which normal sparks are discharged in normal conditions. The second ground electrode is aligned with the center electrode in a radial direction of the spark plug to form a second spark gap across which side sparks are discharged when the insulator is fouled with carbon deposits. The spark plug has an improved structure ensuring that when the insulator is fouled with carbon deposits, side sparks are discharged without formation of channels on the insulator, thereby recovering the insulation properties of the insulator.

18 Claims, 6 Drawing Sheets

| DISTANCE C (mm) | 0.0 | 0.4 | 0.8 | 1.2 | 1.4 | 1.6 | 2.0 |
|---|---|---|---|---|---|---|---|
| DISCHARGE PATH | ALL SIDE SPARKS WERE DISCHARGED CREEPING THROUGH INSULATOR END | | | | A FEW SIDE SPARKS WERE DISCHARGED WITHOUT CREEPING THROUGH INSULATOR END | | |

SPARK PLUG WITH A PLURALITY OF GROUND ELECTRODES

CROSS-REFERENCE TO RELATED APPLICATION

This application claims priority from Japanese Patent Application No. 2004-161827, filed on May 31, 2004, the content of which is hereby incorporated by reference into this application.

BACKGROUND OF THE INVENTION

1. Technical Field of the Invention

The present invention relates generally to spark plugs for internal combustion engines. More particularly, the invention relates to a spark plug which has a center electrode, a first ground electrode aligned with the center electrode in an axial direction of the spark plug to form a first spark gap across which sparks are discharged in normal conditions, and a second ground electrode aligned with the center electrode in a radial direction of the spark plug to form a second spark gap across which sparks are discharged when an insulator of the spark plug is fouled with carbon deposits.

2. Description of the Related Art

Existing spark plugs with a plurality of ground electrodes generally include a tubular metal shell, a cylindrical insulator, a center electrode, a first ground electrode, and a second ground electrode.

The metal shell has a threaded portion for fitting the spark plug into a combustion chamber of an engine.

The insulator has a bore formed therethrough in an axial direction thereof and is fixed in the metal shell such that an end thereof protrudes from an end of the metal shell.

The center electrode is secured in the bore of the insulator and includes a first diameter portion, a second diameter portion, and an intermediate portion provided between the first and second diameter portions. The first diameter portion is positioned outside the bore of the insulator and has a free end. The second diameter portion has a diameter greater than that of the first diameter portion. The intermediate portion has a first interface with the first diameter portion and a second interface with the second diameter portion and tapers from the second interface to the first interface.

The first ground electrode has a base end joined to the end of the metal shell and a tip portion that faces the end of the first diameter portion of the center electrode through a first spark gap in the axial direction of the insulator.

The second electrode has a base end joined to the end of the metal shell and a tip portion that faces the second interface of the intermediate portion of the center electrode with the second diameter portion of the same through a second spark gap in a radial direction of the insulator.

In such a spark plug, normal sparks are discharged across the first spark gap in normal conditions of the spark plug.

However, when the insulator of the spark plug is fouled with carbon deposits, "side sparks" may be discharged, instead of the normal sparks, across the second spark gap.

Specifically, with reference to FIG. 9, the electrical field formed in the spark plug tends to concentrate on the second interface 3*bc* of the intermediate portion 3*b* of the center electrode 3 with the second diameter portion 3*c* of the same. In other words, the electrical field generally has a large strength on the interface 3*bc*. As a result, when the insulator 2 is fouled with carbon deposits, side sparks may be discharged which jump from the interface 3*bc* to an end 5*a* of the tip portion 5*t* of the second ground electrode 5, thereby burning off the carbon deposits.

When the insulator 2 is fouled with carbon deposits, the insulation properties of the insulator 2 are degraded, or even lost. However, with the above arrangement, the spark plug can clean the insulator 2 by itself through burning off the carbon deposits with the side sparks, thereby recovering the insulation properties of the insulator 2.

Japanese Unexamined Patent Publication No. 2001-93645 and Japanese Patent No. 3272615 disclose spark plugs designed to maximize such a "self-clean" effect by burning off the carbon deposits with side sparks. In those spark plugs, the second interface 3*bc* of the intermediate portion 3*b* with the second diameter portion 3*c* is positioned inside the bore 2*b* of the insulator 2, and side sparks are discharged along a discharge path Z as shown in FIG. 9, which includes the whole length between the inner and outer edge of the end 2*a* of the insulator 2.

However, in the above spark plugs, since side sparks pass through the whole length between the inner and outer edge of the end 2*a* of the insulator 2, a channeling problem tends to occur. The channeling problem here denotes a phenomenon in which the end 2*a* of the insulator 2 is melted due to the heat energy transferred thereto from the side sparks that creep through the end 2*a*, thus forming channels along the discharge path Z on the end 2*a*.

On the other hand, Japanese Patent No. 3140006 discloses a spark plug in which the second interface 3*bc* of the intermediate portion 3*b* with the second diameter portion 3*c* is positioned outside the bore 2*b* of the insulator 2. However, in the spark plug, the discharge path Z, along which side sparks are discharged, still includes the whole length between the inner and outer edge of the end 2*a* of the insulator 2. Consequently, the channeling problem still tends to occur.

SUMMARY OF THE INVENTION

The present invention has been made in view of the above-mentioned problem.

It is, therefore, a primary object of the present invention to provide a spark plug that secures the insulation properties of an insulator thereof by burning off the carbon deposits on the insulator with side sparks, while preventing the channeling problem from occurring.

Through experimental investigation, the inventor of the present invention has found that it is possible to prevent the channeling problem by allowing side sparks to be discharged along a discharge path Z as shown in FIG. 4, where side parks pass only part of the length between the inner and outer edge of the end of an insulator.

The inventor has also found that it is possible to recover the insulation properties of the insulator even if the carbon deposits on the insulator may not be completely burnt off with the side sparks discharged along the discharge path Z as shown in FIG. 4. In other words, it is not necessary for side sparks to pass through the whole length between the inner and outer edge of the end of the insulator.

The present invention is derived from the results of the experimental investigation.

According to the first embodiment of the present invention, a spark plug S1 is provided which includes:

a tubular metal shell having a threaded portion on an outer periphery thereof, the threaded portion having an outer diameter in a range of 12 to 14 mm;

a cylindrical insulator fixed in the metal shell, the insulator having a bore, which is formed through the insulator in an axial direction of the insulator, and an end that protrudes from an end of the metal shell;

a center electrode secured in the bore of the insulator, the center electrode having a first diameter portion, a second diameter portion, and an intermediate portion provided between the first and second diameter portions, the first diameter portion being positioned outside the bore of the insulator and having a free end, the second diameter portion having a diameter greater than that of the first diameter portion, the intermediate portion having a first interface with the first diameter portion and a second interface with the second diameter portion and tapering from the second interface to the first interface, the second interface of the intermediate portion with the second diameter portion being positioned outside the bore of the insulator;

a first ground electrode having a base end joined to the end of the metal shell and a tip portion that faces the end of the first diameter portion of the center electrode through a first spark gap in the axial direction of the insulator; and a second ground electrode having a base end joined to the end of the metal shell and a tip portion that faces the second interface of the intermediate portion of the center electrode with the second diameter portion of the same through a second spark gap in a radial direction of the insulator, the tip portion of the second ground electrode also facing in the radial direction of the insulator a tip portion of the insulator which includes the end of the insulator;

wherein the following dimensional relationships are defined:

$$0<C<(A-B); \text{ and}$$

$$1.2 \text{ mm}<(A-B); \text{ where}$$

A is a minimum distance between an inner surface of the tip portion of the insulator and the tip portion of the second ground electrode in the radial direction of the insulator, B is a minimum distance between an outer surface of the tip portion of the insulator and the tip portion of the second ground electrode in the radial direction of the insulator, and C is a distance between the end of the insulator and the second interface of the intermediate portion of the center electrode with the second diameter portion of the same in the axial direction of the insulator.

With the above structure, when the insulator of the spark plug S1 is fouled with carbon deposits, side sparks are discharged without formation of channels on the end of the insulator, thereby recovering the insulation properties of the insulator.

According to the second embodiment of the present invention, a spark plug S2 is provided which includes:

a tubular metal shell having a threaded portion on an outer periphery thereof, the threaded portion having an outer diameter in a range of 12 to 14 mm;

a cylindrical insulator fixed in the metal shell, the insulator having a bore, which is formed through the insulator in an axial direction of the insulator, and an end that protrudes from an end of the metal shell;

a center electrode secured in the bore of the insulator, the center electrode having a first diameter portion and a second diameter portion that has a diameter greater than that of the first diameter portion, the first diameter portion being positioned outside the bore of the insulator and having a free end and an interface with the second diameter portion, the interface between the first and second diameter portions being positioned outside the bore of the insulator;

a first ground electrode having a base end joined to the end of the metal shell and a tip portion that faces the end of the first diameter portion of the center electrode through a first spark gap in the axial direction of the insulator; and a second ground electrode having a base end joined to the end of the metal shell and a tip portion that faces the interface between the first and second diameter portions of the center electrode through a second spark gap in a radial direction of the insulator, the tip portion of the second ground electrode also facing in the radial direction of the insulator a tip portion of the insulator which includes the end of the insulator;

wherein the following dimensional relationships are defined:

$$0<C<(A-B); \text{ and}$$

$$1.2 \text{ mm}<(A-B), \text{ where}$$

A is a minimum distance between an inner surface of the tip portion of the insulator and the tip portion of the second ground electrode in the radial direction of the insulator, B is a minimum distance between an outer surface of the tip portion of the insulator and the tip portion of the second ground electrode in the radial direction of the insulator, and C is a distance between the end of the insulator and the interface between the first and second diameter portions of the center electrode in the axial direction of the insulator.

With the above structure, when the insulator of the spark plug S2 is fouled with carbon deposits, side sparks are discharged without formation of channels on the end of the insulator, thereby recovering the insulation properties of the insulator It is preferable to define for the spark plugs S1 and S2 the following dimensional relationship:

$$0 \leqq F \leqq 0.5H, \text{ where}$$

F is a length of the tip portion of the insulator, which faces the tip portion of the second ground electrode in the radial direction of the insulator, in the axial direction of the insulator, and H is a width of a cross section of the tip portion of the second ground electrode in the axial direction of the insulator, the cross section being perpendicular to the radial direction of the insulator.

As a result, the insulation properties of the insulator can be recovered when it is fouled with carbon deposits, while suppressing formation of a fuel bridge in the spark plug.

It is preferable to define for the spark plugs S1 and S2 the following dimensional relationship:

$$E<A,$$

where E is a size of the first spark gap between the end of the first diameter portion of the center electrode and the tip portion of the first ground electrode in the axial direction of the insulator.

As a result, normal sparks can be reliably discharged across the first spark gap when the insulator of the spark plug is not fouled with carbon deposits.

It is preferable to define for the spark plugs S1 and S2 the dimensional relationship of B<E.

As a result, the ignition capability of the spark plug can be secured with the help of side sparks when the insulator of the spark plug is fouled with carbon deposits.

It is preferable to define for the spark plugs S1 and S2 the following dimensional relationship:

$$(A-B)<2D,$$

where D is a width of a cross section of the tip portion of the second ground electrode in a direction perpendicular to the axial direction of the insulator, the cross section being perpendicular to the radial direction of the insulator.

As a result, the ignition capability of the spark plug can be secured with the help of side sparks when the insulator of the spark plug is fouled with carbon deposits.

It is preferable that in the spark plugs S1 and S2, the first diameter portion of the center electrode is made up of a noble metal chip.

It is also preferable that in the spark plugs S1 and S2, the tip portion of the first ground electrode includes a noble metal chip provided thereon such that the noble metal chip faces the end of the first diameter portion of the center electrode in the axial direction of the insulator.

Using a noble metal chip, the space available for ignition in the first spark gap of the spark plug is increased, while the noble metal chip is made not too thin to be easily worn down.

Further, the noble metal chip is preferably made of one of a Pt-based alloy and an Ir-based alloy.

Specifying the material of the noble chip as above, a long service life is secured for the center electrode and/or the first ground electrode of the spark plug.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
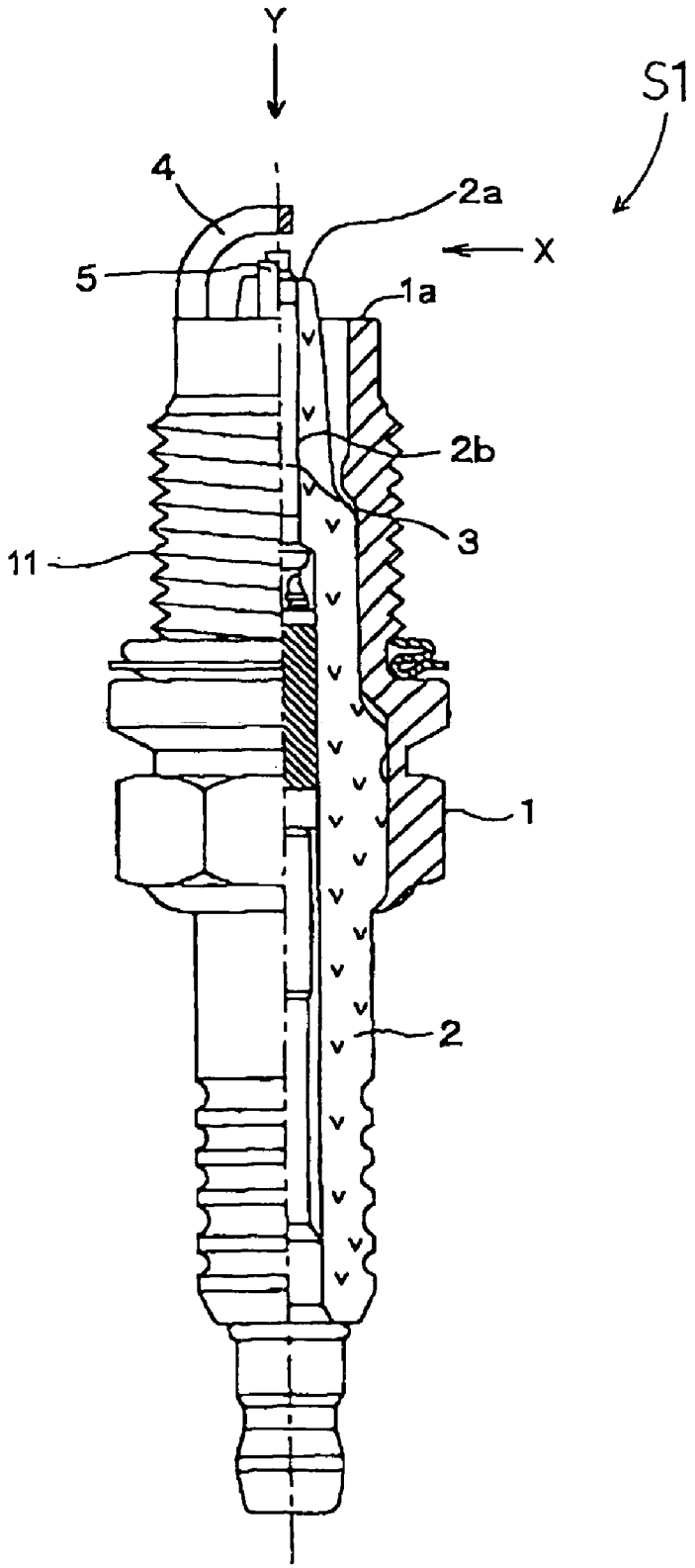
FIG. 1 is a partially cross-sectional side view showing the overall structure of a spark plug according to the first embodiment of the invention.

The preferred embodiments of the present invention will be described hereinafter with reference to FIGS. 1–8.

It should be noted that, for the sake of clarity and understanding, identical components having identical functions in different embodiments of the invention have been marked, where possible, with the same reference numerals in each of the figures.

[First Embodiment]

FIG. 1 shows the overall structure of a spark plug S1 according to the first embodiment of the invention.

The spark plug S1 is designed for use in internal combustion engines of automotive vehicles. The installation of the spark plug S1 in an internal combustion engine is achieved by fitting it into a combustion chamber (not shown) of the engine through a threaded bore provided in the engine head (not shown).

As shown in FIG. 1, the spark plug S1 essentially includes a metal shell 1, an insulator 2, a center electrode 3, a first (main) ground electrode 4, and two second (auxiliary) ground electrodes 5.

The tubular metal shell 1 is made of a conductive metal material, for example low-carbon steel. The metal shell 1 has a threaded portion 11 on the outer periphery thereof for fitting the spark plug S1 into the combustion chamber of the engine as described above.

The threaded potion 11 of the metal shell 1 has an outer diameter in a range of 12 to 14 mm This range corresponds to the range of M12 to M14 as specified in JIS (Japanese Industrial Standards).

The cylindrical insulator 2, which is made of alumina ceramic ($Al_2O_3$), is fixed and partially contained in the metal shell 1 such that an end 2*a* of the insulator 2 protrudes from an end 1*a* of the metal shell 1. The insulator 2 has a bore 2*b* that is formed through the insulator 2 in an axial direction of the insulator 2.

In this embodiment, the end 2*a* of the insulator 2 is away from the end 1*a* of the metal shell 1 by 2.5 mm in the axial direction of the insulator 2.

The center electrode 3 is made of a highly heat conductive metal material such as Cu as the core material and a highly heat-resistant, corrosion-resistant metal material such as a Ni (Nickel)-based alloy as the clad material.

The center electrode 3 is secured in the bore 2*b* of the insulator 2, so that it is electrically isolated from the metal shell 1. The diameter of the center electrode 3 decreases slightly in the bore 2*b* of the insulator 2 along the axial direction of the insulator 2 toward the end 2*a* of the same. For example, the maximum diameter of the center electrode 3 is equal to 2.3 mm, while the minimum one is equal to 2.25 mm. Further, the clearance between the outer surface of the center electrode 3 and the inner surface of the insulator 2 is made more than 50 μm at the end 2*a* of the insulator 2. Additionally, the diameter of the center electrode 3 may also be made constant in the bore 2*b* of the insulator 2 along the axial direction of the same.

Figure 2:
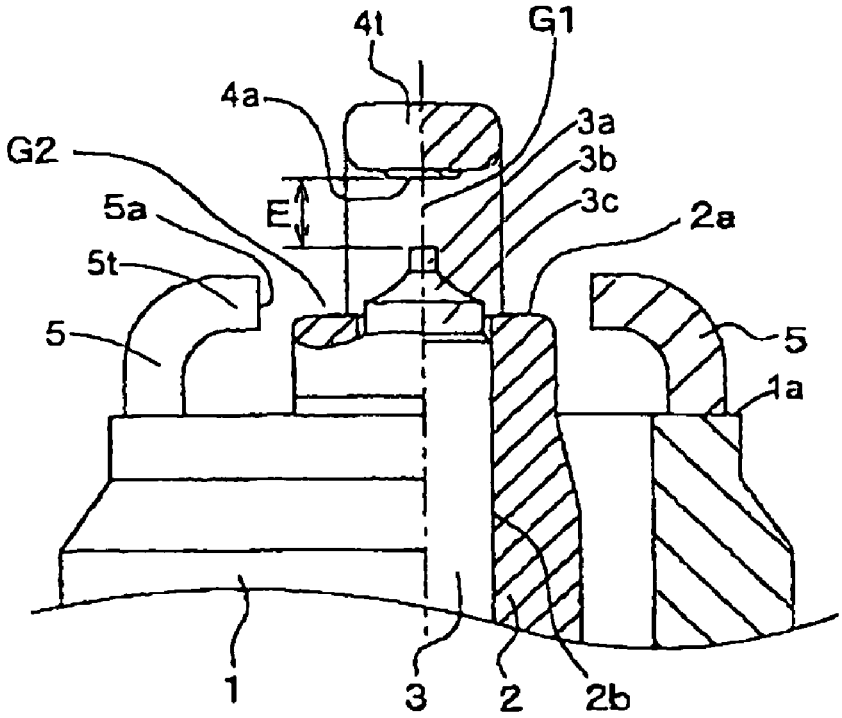
FIG. 2 is a view partially in cross-section along the X direction of FIG. 1 showing a spark gap and the proximity thereof in the spark plug of FIG. 1.
Figure 3:
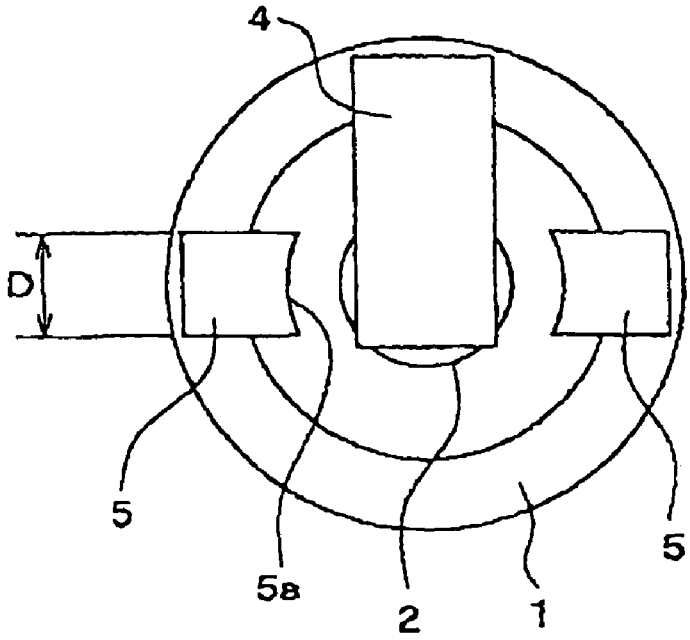
FIG. 3 is an end view along the Y direction of FIG. 1 showing the ground electrodes of the spark plug of FIG. 1.
Figures 4, 5:
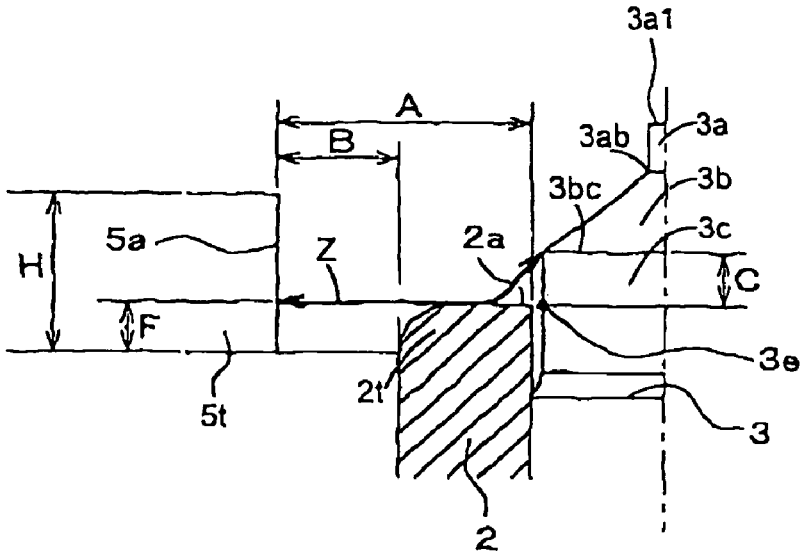
FIG. 4 is an enlarged partially cross-sectional side view illustrating dimensional parameters and a discharge path of side sparks in the spark plug of FIG. 1.
FIG. 5 is a table showing the relationship between a distance C and the resultant discharge path of side sparks in the spark plug of FIG. 1.

Referring now to FIGS. 2–4, the center electrode 3 includes a first diameter portion 3*a*, a second diameter portion 3*c*, and an intermediate portion 3*b* between the first and second diameter portions 3*a* and 3*c*.

The first diameter portion 3*a* of the center electrode 3 has a free end 3*a*1 and is positioned outside the bore 2*b* of the insulator 2.

In this embodiment, the end 3*a*1 of the first diameter portion 3*a* of the center electrode 3 is away from the end 2*a* of the insulator 2 by 1.5 mm in the axial direction of the insulator 2.

It is preferable that the first diameter portion 3*a* of the center electrode 3 is made up of a noble metal chip.

Using a noble metal chip, the space available for ignition in a first spark gap G1 is increased, while the noble metal chip is made not too thin to be easily worn down.

Further, the noble metal chip is preferably made of either a Pt-based alloy or an Ir-based alloy.

Specifying the material of the noble metal chip as above, a long service life is secured for the center electrode 3.

Furthermore, it is preferable that the noble metal chip has a diameter in a range of 0.3 to 1.6 mm and a length in the axial direction thereof in a range of 0.3 to 2 mm.

The second diameter portion 3*c* of the center electrode 3 has a diameter greater than that of the first diameter portion 3*a*.

The intermediate portion 3*b* of the center electrode 3 has, as shown in FIG. 4, a first interface 3*ab* with the first diameter portion 3*a* and a second interface 3*bc* with the second diameter portion 3*c*. The second interface 3*bc* of the intermediate portion 3*b* with the second diameter portion 3*c* is positioned outside the bore 2*b* of the insulator 2.

The intermediate portion 3*b* of the center electrode 3 tapers from the second interface 3*bc* to the first interface 3*ac* with a taper degree, for example, of 110°.

Additionally, in FIG. 4, there is shown a position 3*e* on the outer surface of the second diameter portion 3*c* of the center electrode 3, which faces the second ground electrode 5 in the radial direction of the insulator 2 on a plane that includes the end 2*a* of the insulator 2.

The first ground electrode 4 is made, for example, of a Ni-based alloy, it is column-shaped, for example an approximately L-shaped prism in this embodiment. Specially, the first ground electrode 4 has a cross section of approximately 2.8 mm×1.2 mm perpendicular to a length wise direction thereof.

The first ground electrode 4 has a base end that is joined, for example by welding, to the end 1*a* of the metal shell 1. The first ground electrode 4 also has a tip portion 4*t* that faces the end 3*a*1 of the first diameter portion 3*a* of the center electrode 3 through the first spark gap G1 in the axial direction of the insulator 2. In addition, the first spark gap G1 may have a size E of 1.1 mm.

It is preferable that the tip portion 4*t* of the first ground electrode 4 includes a noble metal chip 4*a* provided thereon as shown in FIG. 2, so that sparks are discharged between the noble metal chip 4*a* and the end 3*a*1 of the first diameter portion 3*a* of the center electrode 3.

Using a noble metal chip, the space available for ignition in the first spark gap G1 is increased, while the noble metal chip is made not too thin to be easily worn down.

Further, the noble metal chip 4*a* is preferably made of either a Pt-based alloy or an Ir-based alloy.

Specifying the material of the noble metal chip as above, a long service life is secured for the first ground electrode 4.

On the other hand, each of the second ground electrodes 5 is made, for example, of a Ni-based alloy; it is column-shaped, for example an approximately L-shaped prism in this embodiment. Specially, each of the second ground electrodes 5 has a cross section of approximately 2.2 mm×1.2 mm perpendicular to a length wise direction thereof.

Each of the second ground electrodes 5 has a base end that is joined, for example by welding, to the end 1*a* of the metal shell 1. Each of the second ground electrodes 5 also has a tip portion 5*t* that has an end 5*a*.

As shown in FIG. 4, the end 5*a* faces the second interface 3*bc* of the intermediate portion 3*b* of the center electrode 3 with the second diameter portion 3*c* of the same through a second spark gap G2 in a radial direction of the insulator 2. The end 5*a* also faces a tip portion 2*t* of the insulator 2, which includes the end 2*a* of the insulator 2, in the radial direction of the insulator 2.

In this embodiment, as shown in FIG. 3, the end 5*a* of the tip portion 5*t* of each of the second ground electrodes 5 is recessed in the radial direction of the insulator 2; however, it may has other shapes, for example a flat plane.

In the above-described spark plug S1, when the end 2*a* of the insulator 2 is not fouled with carbon deposits, normal sparks are discharged across the first spark gap G1, thereby igniting the air-fuel mixture.

However, when the end 2*a* of the insulator 2 of the spark plug S1 is fouled with carbon deposits due to incomplete burning of the air-fuel mixture, side sparks are discharged, instead of normal sparks, across the second spark gap G2.

Specifically, as shown in FIG. 4, the side sparks are discharged along the discharge path Z, where the side sparks creep through part of the end 2*a* of the insulator 2. As a result, the carbon deposits on the end 2*a* of the insulator 2 are burnt off, thereby recovering the insulation properties of the insulator 2.

After the insulation properties of the insulator 2 are recovered, normal sparks are again discharged across the first spark gap G1.

Having described the essential components and basic operation of the spark plug S1, the dimensional parameters designated as A, B, C, D, E, F, and H in FIGS. 2–4 will be defined below. Those parameters influence the insulation properties of the insulator 2 and occurrence of the channeling problem, thus are critical to the structure of the spark plug S1.

A is a minimum distance between the inner surface of the tip portion 2*t* of the insulator 2 and the end 5*a* of the tip portion 5*t* of the second ground electrode 5 in the radial direction of the insulator 2 (referred to as distance A hereinafter).

B is a minimum distance between the outer surface of the tip portion 2*t* of the insulator 2 and the end 5*a* of the tip portion 5*t* of the second ground electrode 5 in the radial direction of the insulator 22 (referred to as distance B hereinafter).

C is a distance between the end 2*a* of the insulator 2 and the second interface 3*bc* of the intermediate portion 3*b* of the center electrode 3 with the second diameter portion 3*c* of the same in the axial direction of the insulator 2 (referred to as distance C hereinafter).

D is a width of a cross section of the tip portion 5*t* of the second ground electrode 5 in a direction perpendicular to the axial direction of the insulator 2, the cross section being perpendicular to the radial direction of the insulator 2 (referred to as width D of the tip portion 5*t* of the second ground electrode 5 hereinafter).

E is a size of the first spark gap G1 between the end 3*a*1 of the first diameter portion 3*a* of the center electrode 3 and the tip portion 4*t* of the first ground electrode 4 in the axial direction of the insulator 2 (referred to as first spark gap size E hereinafter).

F is a length of the tip portion 2*t* of the insulator 2, which faces the end 5*a* of the tip portion 5*t* of the second ground electrode 5 in the radial direction of the insulator 2, in the axial direction of the insulator 2 (referred to as length F of the tip portion 2*t* of the insulator 2 hereinafter).

H is a width of a cross section of the tip portion 5*t* of the second ground electrode 5 in the axial direction of the insulator 2, the cross section being perpendicular to the radial direction of the insulator 2 (referred to as width H of the tip portion 5*t* of the second ground electrode 5 hereinafter).

The effective ranges of the above-defined parameters, which characterize the structure of the spark plug S1 according to the present embodiment, have been determined through experimental investigation and experience as follows.

First, the effective range of the distance C has been determined through experimental investigation.

It should be noted that a positive C (i.e., C>0) indicates that the second interface 3*bc* of the intermediate portion 3*b* of the center electrode 3 with the second diameter portion 3*c* of the same is positioned outside the bore 2 of the insulator 2, while a negative C indicates that the same is positioned inside the bore 2.

Sample spark plugs of seven different types were fabricated for the investigation. Those sample plug types had different distances C, but the same distances A and B. Specifically, for all the sample plug types, A=1.9 mm, B=0.5 mm, and accordingly, (A−B)=1.4 mm.

In the investigation, sample spark plugs were tested within a hermetically sealed chamber, where the pressure was kept at 0.6 Mpa. For each of the tested sample spark plugs, sparks were discharged at a frequency of 5 Hz, and the discharge path of the sparks was observed.

FIG. 4 shows the results of the experimental investigation. As seen from the figure, for those sample spark plugs which have a distance C of less than (A−B) (i.e., 1.4 mm), all side sparks were discharged creeping through the end 2*a* of the insulator 2. On the hand, for those sample spark plugs which have a distance C of equal to or greater than (A−B), a few side sparks were discharged without creeping through the end 2*a* of the insulator 2.

Accordingly, defining C<(A−B) for the spark plug S1, all side sparks will be discharged creeping through the end 2*a* of the insulator 2 of the spark plug S1, thereby recovering the insulation properties of the insulator 2.

Secondly, the effective range of a difference (A−B) between the distances A and B has been determined through experimental investigation.

It should be noted that the difference (A−B) corresponds to the radial thickness of the tip portion 2*t* of the insulator 2.

Sample spark plugs having different distances C and/or different differences (A−B) were fabricated. Specifically, for the sample spark plugs, the differences (A−B) of 0.6, 0.8, 1.0, 1.2, 1.4, and 1.6 mm were obtained by varying the distance A while fixing the distance B to 0.5 mm. The distances C of −0.2, 0, 0.2, 0.4, and 0.6 mm were used for the sample spark plugs.

Further, in the sample spark plugs, the first ground electrode 4 had been removed, so that only side sparks could be discharged between the center electrode 3 and the second ground electrode 5.

In the investigation, each of the sample spark plugs was installed to a direct-injection engine of 3000 CC and continuously operated at high load for 100 hours. After that, the condition of each of the sample spark plugs was checked as to whether channels were formed on the end 2*a* of the insulator 2 of the sample spark plug.

Figure 6:
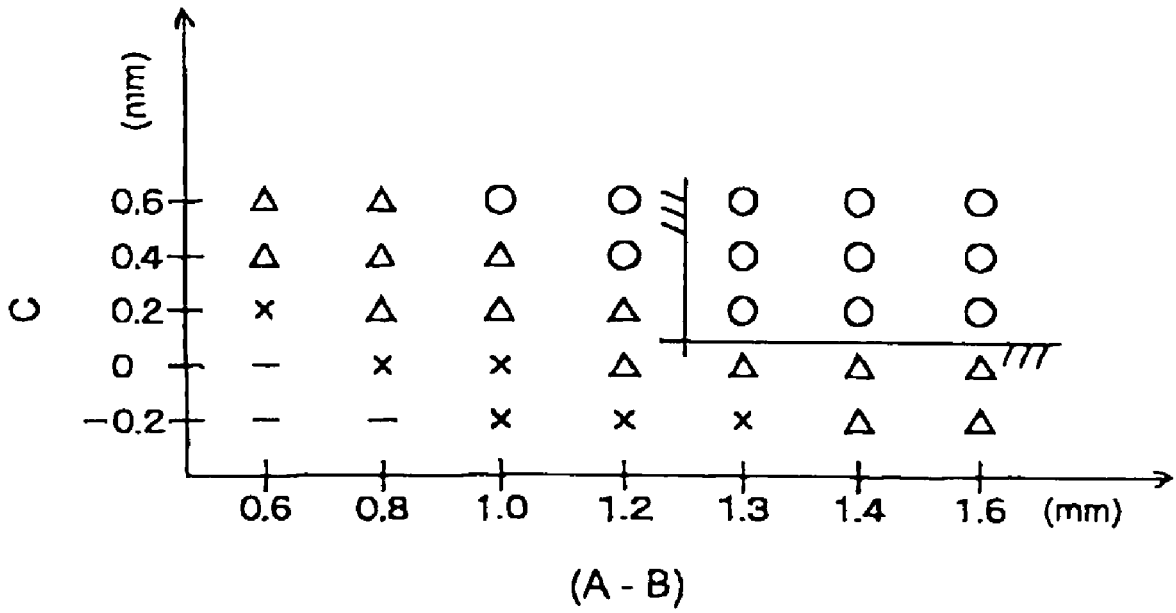
FIG. 6 is a graphical representation showing the relationship between the distance C, a difference (A−B), and occurrence of channels on an end of an insulator in the spark plug of FIG. 1.

FIG. 6 shows the results of the experimental investigation. In the figure, the horizontal axis indicates the difference (A−B), while the vertical one indicates the distance C. Further, the plot of "○" indicates that no or only a few channels were formed, the plot of "Δ" indicates that shallow channels were formed, and the plot of "X" indicates that deep channels were formed.

It can be seen from FIG. 6 that in those sample spark plugs, where the distance C was greater than zero and the difference (A−B) was greater than 1.2 mm, side sparks were discharged with no or only a few channels formed on the end 2*a* of the insulator 2 thereof.

This is because when the distance C in a spark plug is greater than zero, the discharge of side sparks is stared outside the bore 2 of the insulator 2 of the spark plug, thus alleviating the damage caused by side sparks to the end 2*a* of the insulator 2.

Further, when the difference (A−B) in a spark plug, which corresponds to the radial thickness of the tip portion 2*t* of the insulator 2 of the spark plug, is greater than 1.2 mm, the heat energy transferred from side sparks to the end 2*a* of the insulator 2 can be effectively dissipated, thus preventing formation of channels on the end 2*a* of the insulator 2.

Accordingly, defining 0<C and 1.2 mm<(A−B) for the spark plug S1, all side sparks will be discharged without formation of channels on the end 2*a* of the insulator 2 of the spark plug S1.

Thirdly, with respect to the width D of the tip portion 5*t* of the second ground electrode 5, it has been found that when (A−B)>2D, "inside sparks" tend to occur, instead of side sparks, when the insulator 2 of a spark plug is fouled with carbon deposits.

The inside sparks here denote sparks which creep along the outer surface of the insulator 2 toward the inside of an air pocket formed between the outer surface of the insulator 2 and the inner surface of the metal shell 1 and fly across the air pocket to an inside portion of the inner surface of the metal shell 1. Further, since the space for ignition in the inside of the air pocket is so small that ignition therein cannot be successful, it is required to prevent inside sparks from occurring.

Accordingly, it is preferable to define (A−B)<2D for the spark plug S1, so that the ignition capability of the spark plug S1 can be ensured.

Fourthly, with respect to the first spark gap size E, it is preferable to define E<A for the spark plug S1, so that normal sparks can be reliably discharged across the first spark gap G1 when the insulator 2 of the spark plug S1 is not fouled with carbon deposits.

Further, when E<B, inside sparks tend to occur, instead of side sparks, when the insulator 2 of the spark plug S1 is fouled with carbon deposits.

Accordingly, it is preferable to define B<E for the spark plug S1, so that the ignition capability of the spark plug S1 can be secured.

Finally, with respect to the length F of the tip portion 2*t* of the insulator 2 and the width H of the tip portion 5*t* of the second ground electrode 5, it is preferable to define F≦0.5H for the spark plug S1, so that the area of the end 5*a* of the tip portion 5*t* of the second ground electrode 5 which faces the tip portion 2*t* of the insulator 2 can be prevented from becoming too large, thereby suppressing formation of a fuel-bridge therebetween.

The fuel bridge here denotes a phenomenon in which the space between the end 5*a* of the tip portion 5*t* of the second ground electrode 2 and the outer surface of the tip portion 2*t* of the insulator 2 is filled with liquid fuel, thus forming a bridge of fuel across the space.

Further, it is necessary to define 0≦F for the spark plug S1, so that side sparks can be discharged which creep through the end 2*a* of the insulator 2, thereby recovering the insulation properties of the insulator 2.

Accordingly, it is preferable to define 0≦F≦0.5H for the spark pug S1, so that the insulation properties of the insulator 2 can be recovered when it is fouled with carbon deposits, while suppressing formation of the fuel bridge in the spark plug S1.

To sum up, the spark plug S1 according to the present embodiment includes a tubular metal shell 1, an insulator 2, a center electrode 3, a first ground electrode 4, and two second ground electrodes 5.

The metal shell 1 has a threaded portion 11 on an outer periphery thereof, which has an outer diameter in a range of 12 to 14 mm.

The insulator 2 is fixed in the metal shell 1. The insulator 2 has a bore 2*b*, which is formed through the insulator 2 in an axial direction of the insulator 2, and an end 2*a* that protrudes from an end 1*a* of the metal shell 1.

The center electrode 3 is secured in the bore 2*b* of the insulator 2. The center electrode 3 has a first diameter portion 3*a*, a second diameter portion 3*c*, and an intermediate portion 3*b* provided between the first and second diameter portions 3*a* and 3*c*. The first diameter portion 3*a* is positioned outside the bore 2*b* of the insulator 2 and has a free end 3*a*1. The second diameter portion 3*c* has a diameter greater than that of the first diameter portion 3*a*. The intermediate portion 3*b* has a first interface 3*ab* with the first diameter portion 3*a* and a second interface 3*bc* with the second diameter portion 3*c* and tapers from the second interface 3*bc* to the first interface 3*ab*. The second interface 3*bc* of the intermediate portion 3*b* with the second diameter portion 3*c* is positioned outside the bore 2*b* of the insulator 2.

The first ground electrode 4 has a base end joined to the end 1*a* of the metal shell 1 and a tip portion 4*t* that faces the end 3*a*1 of the first diameter portion 3*a* of the center electrode 3 through a first spark gap G 1 in the axial direction of the insulator 2.

Each of the second ground electrodes 5 has a base end joined to the end 1*a* of the metal shell 1 and a tip portion 5*t* that faces the second interface 3*bc* of the intermediate portion 3*b* of the center electrode 3 with the second diameter portion 3*c* of the same through a second spark gap G2 in a radial direction of the insulator 2. The tip portion 5*t* of each of the second ground electrodes 5 also faces in the radial direction of the insulator 2 a tip portion 2*t* of the insulator 2 which includes the end 2*a* of the insulator 2.

The spark plug S1 has an improved structure in which the dimensional parameters including the distance A, the distance B, and the distance C satisfy the following dimensional relationships:

$$0<C<(A-B);\text{ and}$$

$$1.2\text{ mm}<(A-B).$$

With the above structure, when the insulator 2 of the spark plug S1 is fouled with carbon deposits, side sparks are discharged without formation of channels on the end 2*a* of the insulator 2, thereby recovering the insulation properties of the insulator 2.

[Second Embodiment]

In this embodiment, a spark plug S2 is provided which has a structure almost identical to that of the spark plug S1 according to the previous embodiment. Accordingly, only the difference in structure between the spark plugs S1 and S2 is to be described below.

As described previously, in the spark plug S1, the center electrode 3 has an intermediate portion 3*b* provided between the first diameter portion 3*a* and the second diameter portion 3*c*. The intermediate portion 3*b* has a first interface 3*ab* with the first diameter portion 3*a* and a second interface 3*bc* with the second diameter portion 3*c* and tapers from the second interface 3*bc* to the first interface 3*ab*. The second interface 3*bc* is positioned outside the bore 2*b* of the insulator 2 and faces the end 5*a* of the tip portion 5*t* of the second ground electrode 5 in a radial direction of the insulator 2.

In comparison, in the spark plug S2, the center electrode 3 has a first diameter portion 3*a* and a second diameter portion 3*c*, but no intermediate portion 3*b* provided therebetween.

Figure 7:
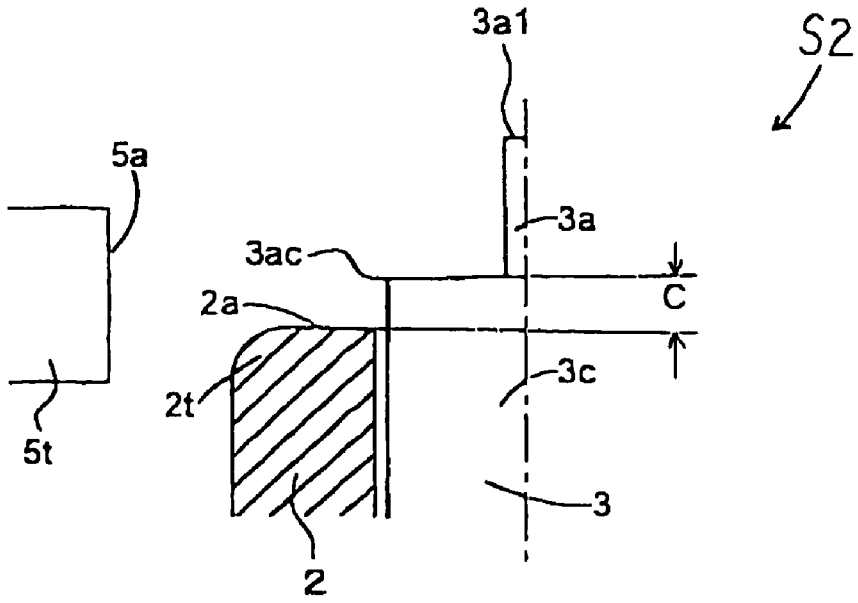
FIG. 7 is an enlarged partially cross-sectional side view showing a spark gap and the proximity thereof in a spark plug according to the second embodiment of invention.

As shown in FIG. 7, the second diameter portion 3*c* has a diameter greater than that of the first diameter portion 3*a* and there is an interface 3*ac* between the first and second diameter portions 3*a* and 3*c*. The interface 3*ac* is positioned outside the bore 2*b* of the insulator 2 and faces the end 5*a* of the tip portion 5*t* of the second ground electrode 5 in a radial direction of the insulator 2.

In the spark plug S2, the dimensional parameters A, B, D, E, F, and H, which influence the insulation properties of the insulator 2 and occurrence of the channeling problem, have the same definitions as in the spark plug S1.

However, in the spark plugs S1 and S2, the distance C has different definitions. In the spark plug S2, the distance C is defined as a distance between the end 2*a* of the insulator 2 and the interface 3*ac* between the first and second diameter portions 3*a* and 3*c* of the center electrode 3.

The inventor of the present invention has confirmed through experimental investigation that the dimensional relation ships defined for the spark plug S1 between the parameters A, B, C, D, E, F, and H are still useful, and accordingly can provide the same effects to the spark plug S2.

Thus, description of the dimensional relationships and the effects thereof is not repeated here.

While the above particular embodiments of the invention have been shown and described, it will be understood by those who practice the invention and those skilled in the art that various modifications, changes, and improvements may be made to the invention without departing from the spirit of the disclosed concept.

Figure 8:
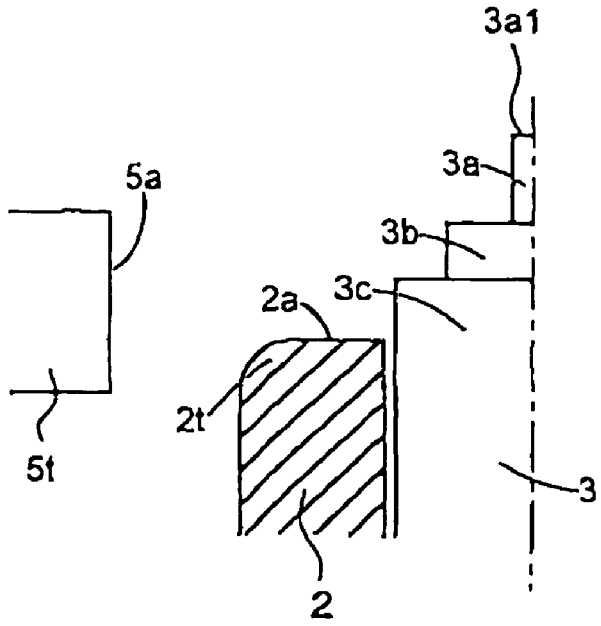
FIG. 8 is an enlarged partially cross-sectional side view illustrating a possible modification of the spark plug of FIG. 1.
Figure 9:
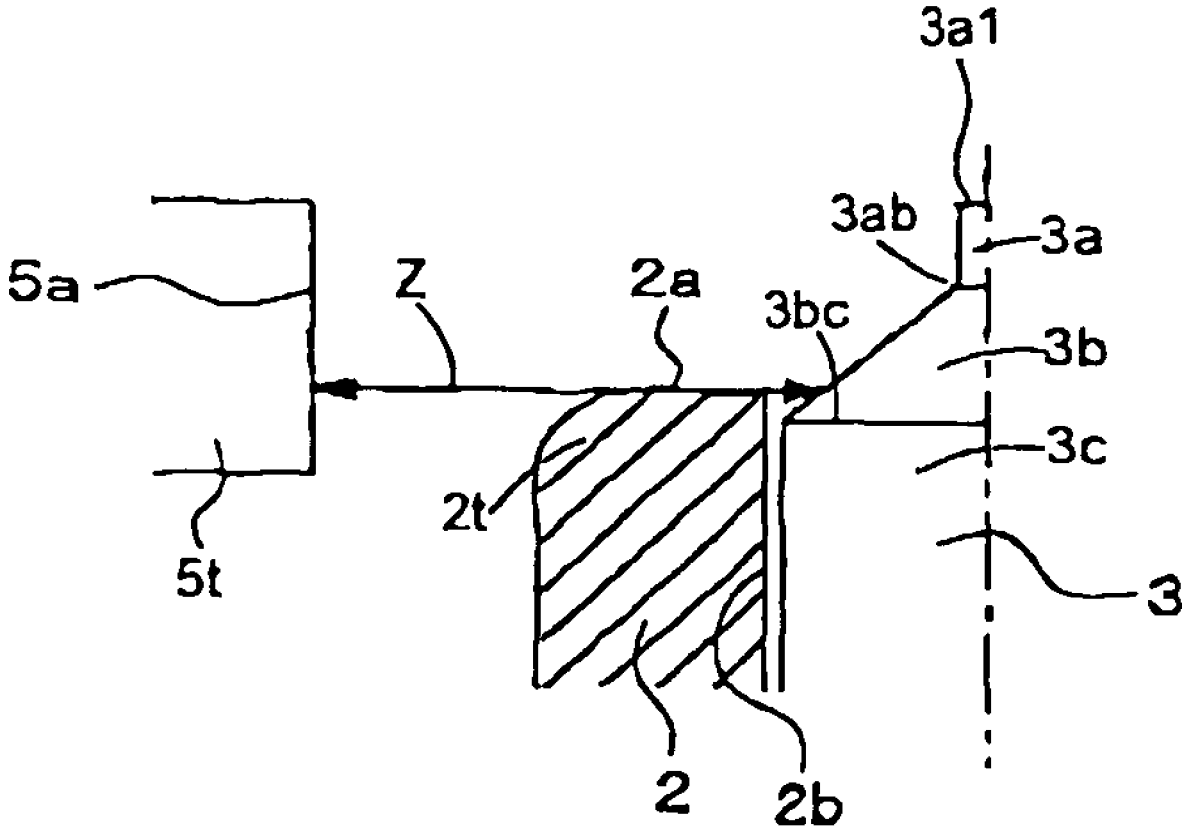
FIG. 9 (PRIOR ART)
FIG. 9 is an enlarged partially cross-sectional side view showing a spark gap and the proximity thereof in a prior art spark plug.

For example, in the previous embodiments, the center electrode 3 may have an intermediate portion 3*b* as shown in FIG. 8 between the first and second diameter portions 3*a* and 3*c*.

Such modifications, changes, and improvements within the skill of the art are intended to be covered by the appended claims.

What is claimed is:

1. A spark plug comprising:

a tubular metal shell having a threaded portion on an outer periphery thereof, the threaded portion having an outer diameter in a range of 12 to 14 mm;

a cylindrical insulator fixed in said metal shell, said insulator having a bore, which is formed through said insulator in an axial direction of said insulator, and an end that protrudes from an end of said metal shell;

a center electrode secured in the bore of said insulator, said center electrode having a first diameter portion, a second diameter portion, and an intermediate portion provided between the first and second diameter portions, the first diameter portion being positioned outside the bore of said insulator and having a free end, the second diameter portion having a diameter greater than that of the first diameter portion, the intermediate portion having a first interface with the first diameter portion and a second interface with the second diameter portion and tapering from the second interface to the first interface, the second interface of the intermediate portion with the second diameter portion being positioned outside the bore of said insulator;

a first ground electrode having a base end joined to the end of said metal shell and a tip portion that faces the end of the first diameter portion of said center electrode through a first spark gap in the axial direction of said insulator; and a second ground electrode having a base end joined to the end of said metal shell and a tip portion that faces the second interface of the intermediate portion of said center electrode with the second diameter portion of the same through a second spark gap in a radial direction of said insulator, the tip portion of said second ground electrode also facing in the radial direction of said insulator a tip portion of said insulator which includes the end of said insulator;

wherein the following dimensional relationships are defined:

$0<C<(A-B)$; and 1.2 mm$<(A-B)$; where

A is a minimum distance between an inner surface of the tip portion of said insulator and the tip portion of said second ground electrode in the radial direction of said insulator, B is a minimum distance between an outer surface of the tip portion of said insulator and the tip portion of said second ground electrode in the radial direction of said insulator, and C is a distance between the end of said insulator and the second interface of the intermediate portion of said center electrode with the second diameter portion of the same in the axial direction of said insulator.

2. The spark plug as set forth in claim 1, wherein the following dimensional relationship is further defined:

$0 \leqq F \leqq 0.5H$, where

F is a length of the tip portion of said insulator, which faces the tip portion of said second ground electrode in the radial direction of said insulator, in the axial direction of said insulator, and H is a width of a cross section of the tip portion of said second ground electrode in the axial direction of said insulator, the cross section being perpendicular to the radial direction of said insulator.

3. The spark plug as set forth in claim 1, wherein the following dimensional relationship is further defined:

$E<A$, where E is a size of the first spark gap between the end of the first diameter portion of said center electrode and the tip portion of said first ground electrode in the axial direction of said insulator.

4. The spark plug as set forth in claim 1, wherein the following dimensional relationship is further defined:

$B<E$, where E is a size of the first spark gap between the end of the first diameter portion of said center electrode and the tip portion of said first ground electrode in the axial direction of said insulator.

5. The spark plug as set forth in claim 1, wherein the following dimensional relationship is further defined:

$(A-B)<2D$, where D is a width of a cross section of the tip portion of said second ground electrode in a direction perpendicular to the axial direction of said insulator, the cross section being perpendicular to the radial direction of said insulator.

6. The spark plug as set forth in claim 1, wherein the first diameter portion of said center electrode is made up of a noble metal chip.

7. The spark plug as set forth in claim 6, wherein the noble metal chip is made of one of a Pt-based alloy and an Ir-based alloy.

8. The spark plug as set forth in claim 1, wherein the tip portion of said first ground electrode includes a noble metal chip provided thereon such that the noble metal chip faces the end of the first diameter portion of the center electrode in the axial direction of the insulator.

9. The spark plug as set forth in claim 8, wherein the noble metal chip is made of one of a Pt-based alloy and an Ir-based alloy.

10. A spark plug comprising:

a tubular metal shell having a threaded portion on an outer periphery thereof, the threaded portion having an outer diameter in a range of 12 to 14 mm;

a cylindrical insulator fixed in said metal shell, said insulator having a bore, which is formed through said insulator in an axial direction of said insulator, and an end that protrudes from an end of said metal shell;

a center electrode secured in the bore of said insulator, said center electrode having a first diameter portion and a second diameter portion that has a diameter greater than that of the first diameter portion, the first diameter portion being positioned outside the bore of said insulator and having a free end and an interface with the second diameter portion, the interface between the first and second diameter portions being positioned outside the bore of said insulator;

a first ground electrode having a base end joined to the end of said metal shell and a tip portion that faces the end of the first diameter portion of said center electrode through a first spark gap in the axial direction of said insulator; and a second ground electrode having a base end joined to the end of said metal shell and a tip portion that faces the interface between the first and second diameter portions of said center electrode through a second spark gap in a radial direction of said insulator, the tip portion of said second ground electrode also facing in the radial direction of said insulator a tip portion of said insulator which includes the end of said insulator;

wherein the following dimensional relationships are defined:

$0<C<(A-B)$; and 1.2 mm$<(A-B)$, where

A is a minimum distance between an inner surface of the tip portion of said insulator and the tip portion of said second ground electrode in the radial direction of said insulator, B is a minimum distance between an outer surface of the tip portion of said insulator and the tip portion of said second ground electrode in the radial direction of said insulator, and C is a distance between the end of said insulator and the interface between the first and second diameter portions of said center electrode in the axial direction of said insulator.

11. The spark plug as set forth in claim 10, wherein the following dimensional relationship is further defined:

$0 \leqq F \leqq 0.5H$, where

F is a length of the tip portion of said insulator, which faces the tip portion of said second ground electrode in the radial direction of said insulator, in the axial direction of said insulator, and H is a width of a cross section of the tip portion of said second ground electrode in the axial direction of said insulator, the cross section being perpendicular to the radial direction of said insulator.

12. The spark plug as set forth in claim 10, wherein the following dimensional relationship is further defined:

$E<A$, where E is a size of the first spark gap between the end of the first diameter portion of said center electrode and the tip portion of said first ground electrode in the axial direction of said insulator.

13. The spark plug as set forth in claim 10, wherein the following dimensional relationship is further defined:

$B<E$, where E is a size of the first spark gap between the end of the first diameter portion of said center electrode and the tip portion of said first ground electrode in the axial direction of said insulator.

14. The spark plug as set forth in claim 10, wherein the following dimensional relationship is further defined;

$(A-B)<2D$, where D is a width of a cross section of the tip portion of said second ground electrode in a direction perpendicular to the axial direction of said insulator, the cross section being perpendicular to the radial direction of said insulator.

15. The spark plug as set forth in claim 10, wherein the first diameter portion of said center electrode is made up of a noble metal chip.

16. The spark plug as set forth in claim 15, wherein the noble metal chip is made of one of a Pt-based alloy and an Ir-based alloy.

17. The spark plug as set forth in claim 10, wherein the tip portion of said first ground electrode includes a noble metal chip provided thereon such that the noble metal chip faces the end of the first diameter portion of the center electrode in the axial direction of the insulator.

18. The spark plug as set forth in claim 17, wherein the noble metal chip is made of one of a Pt-based alloy and an Ir-based alloy.

* * * * *